US005480333A

United States Patent [19]

Larson

[11] Patent Number: 5,480,333

[45] Date of Patent: Jan. 2, 1996

[54] LOCOMOTIVE CONTROL SIMULATOR ATTACHMENT FOR MODEL ELECTRIC TRAIN CONTROLLERS

[76] Inventor: Bradley S. Larson, 5224 Arbor La., Crestwood, Ill. 50445-1206

[21] Appl. No.: 243,686

[22] Filed: May 16, 1994

[51] Int. Cl.[6] ..... A63H 17/20; A63H 29/20; B60L 15/00

[52] U.S. Cl. ..... 446/7; 446/429; 104/295

[58] Field of Search ..... 446/7, 429, 444, 446/445, 446, 447, 467, 410; 104/295, 53, DIG. 1; 105/61, 1.5

[56] References Cited

U.S. PATENT DOCUMENTS

| | | | |
|---|---|---|---|
| 2,661,461 | 12/1953 | Haury . | |
| 3,972,017 | 7/1976 | Dohanic et al. . | |
| 5,050,505 | 9/1991 | Konno | 104/295 |
| 5,085,148 | 2/1992 | Konno | 104/295 |

OTHER PUBLICATIONS

Tech II, Model Railroader, Mar. 1981, last page.
Zero 1, Model Railroader, Mar. 1981.
Tech II, Locomotion 2500, Model Railroader, p. 2 Mar. 1989.

*Primary Examiner*—Robert A. Hafer
*Assistant Examiner*—D. Neal Muir
*Attorney, Agent, or Firm*—Gerlach & O'Brien

[57] ABSTRACT

A locomotive control simulator attachment for a model train controller having a protruding throttle control shaft reciprocally rotatable for regulating the speed of the train includes a support adapted to be attached to the controller, mechanism, such as a pinion gear and rack combination, that is engageable with the throttle control shaft for reciprocally rotating the shaft, a throttle control lever simulating a locomotive throttle, mechanism for mounting the lever on the support for reciprocal pivotal movement of the lever, and mechanism for connecting the lever to the mechanism engageable with the shaft, for operating the latter mechanism to reciprocally rotate the shaft upon reciprocal pivotal movement of the lever, whereby in regulating the speed of a model train, the lever movement simulates the movement of a full-scale railroad locomotive throttle. The attachment may be attached to a model train controller having sliding actuators for switches or the like that regulate other conditions of operation, such as direction, braking, and momentum. Preferred embodiments of the attachment include one or more control lever-operated mechanisms that operate the actuators, simulating full-scale locomotive controls.

10 Claims, 5 Drawing Sheets

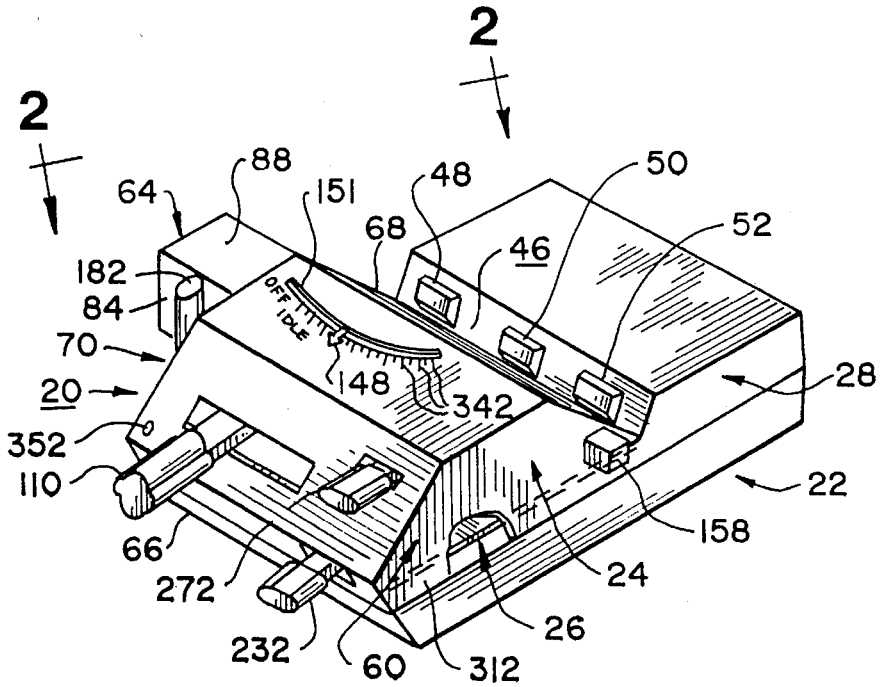
Fig. 1
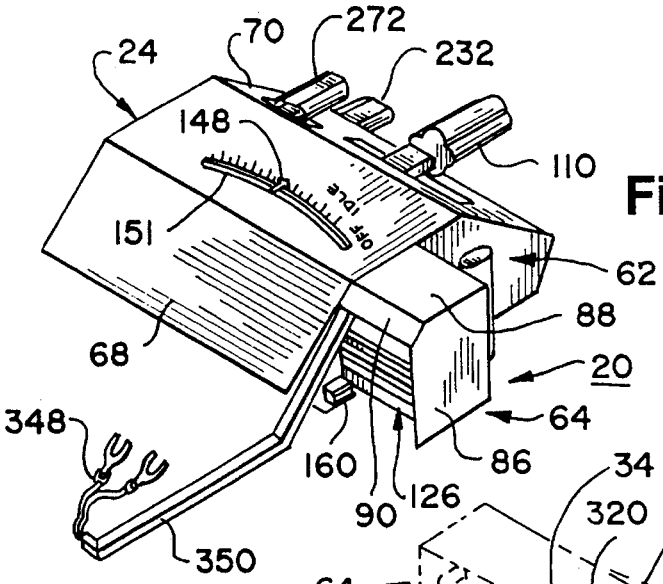
Fig. 2
Fig. 3
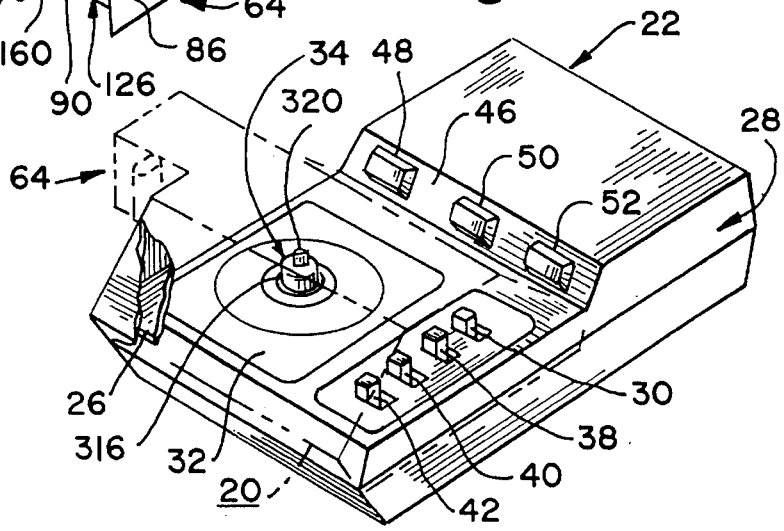

Fig. 5
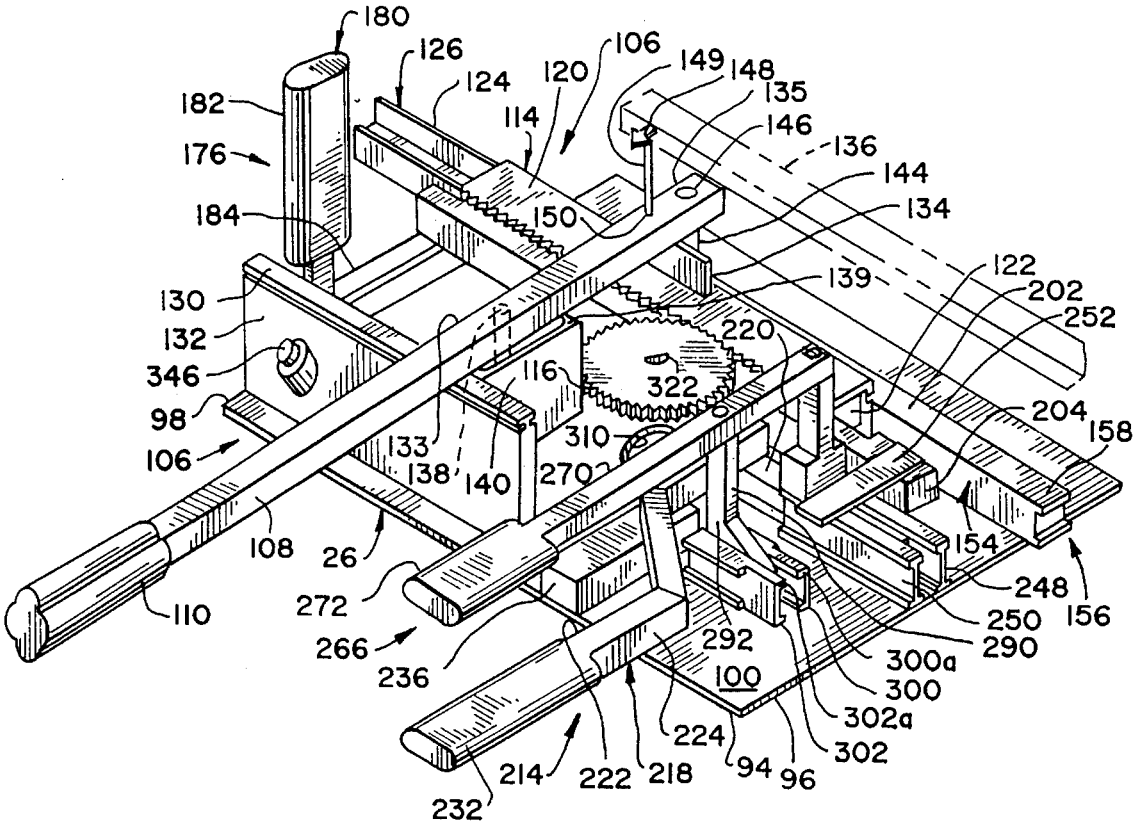
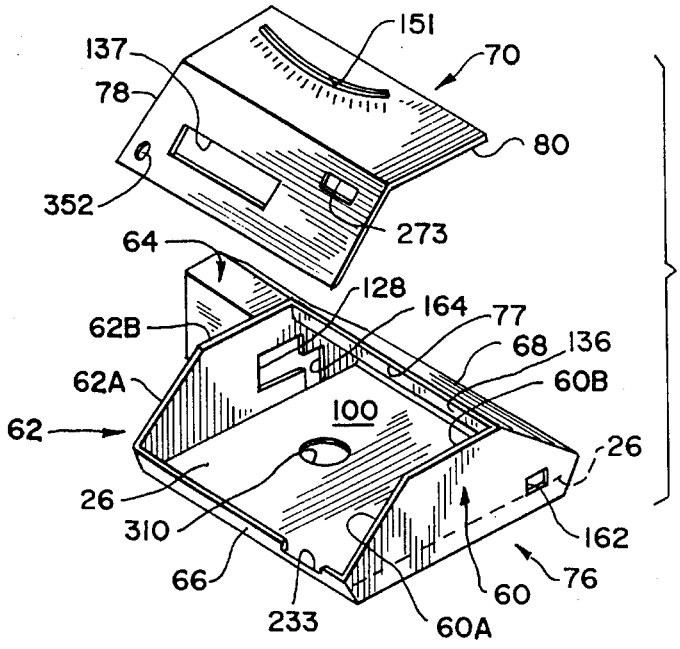
Fig. 4

Fig. 7
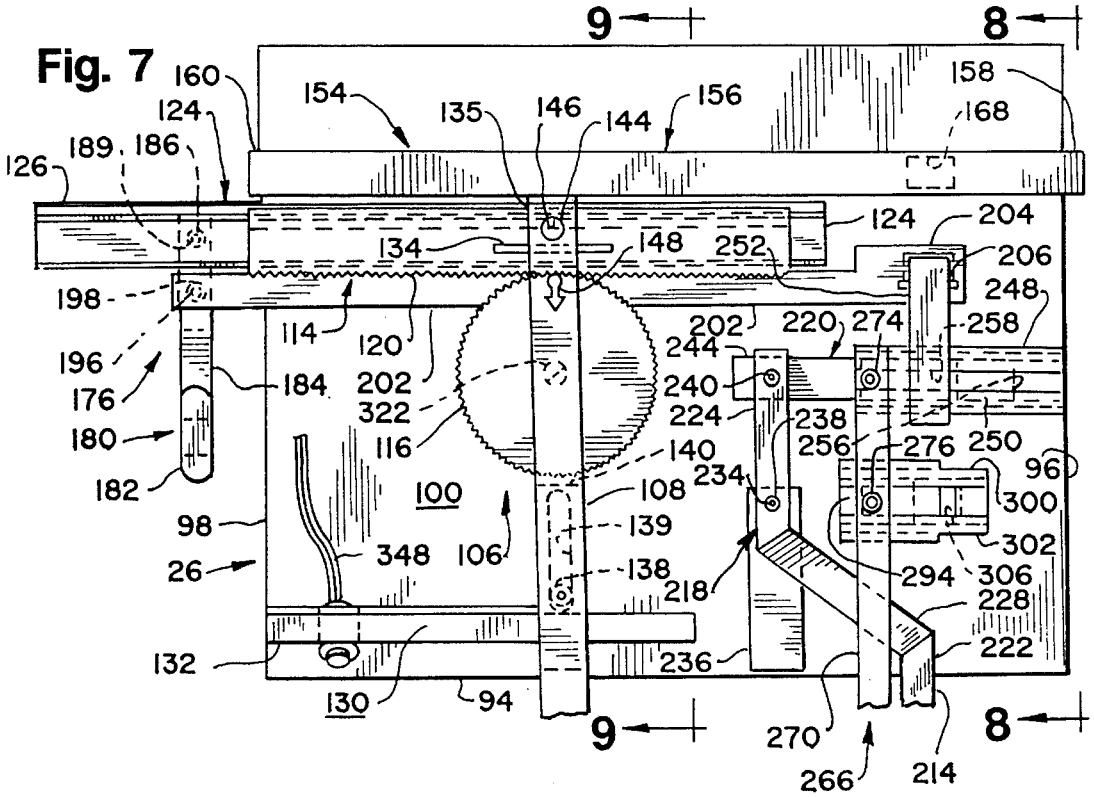
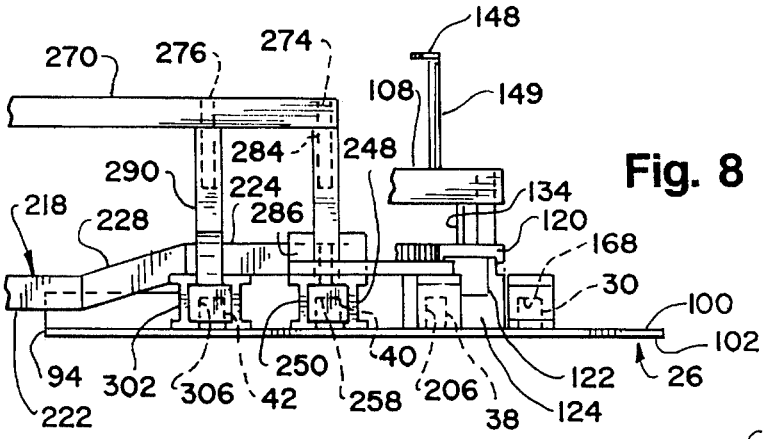
Fig. 8
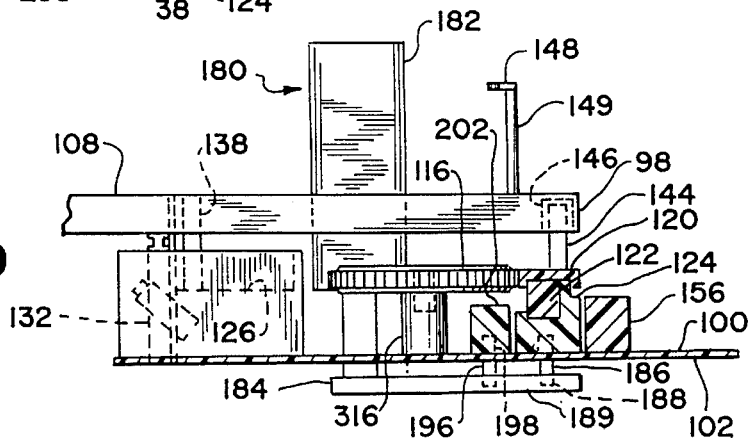
Fig. 9

LOCOMOTIVE CONTROL SIMULATOR ATTACHMENT FOR MODEL ELECTRIC TRAIN CONTROLLERS

BACKGROUND OF THE INVENTION

This invention relates to controllers for model electric railroad trains, more particularly, to a controller attachment providing more realistic simulation of full-scale train controls.

Model electric trains commonly are controlled by controller units which supply the electrical power required by the train and which include controls for regulating its operation, including starting, operating speed, direction of movement and stopping.

To enhance the enjoyment of a model railroader using a controller, it is desirable that the operation of controls be as realistic as possible: the general appearance and the manner of movement of a control regulating an operating condition preferably should simulate the general appearance and manner of movement of the corresponding control of a full-scale or full-size railroad locomotive.

A realistic throttle or speed control for a model train is especially desirable, since this control is used by a model railroader to regulate the starting, acceleration, running speed and deceleration of a model train. Realism might be enhanced by providing additional control mechanisms constructed to simulate full-scale locomotive controls. The additional mechanisms might relate to one or both of the "direction" and "brake" controls. Further, a "momentum" control, which is not present in a full-scale locomotive but which is included in some model train controllers, might be made to appear more realistic by providing a "momentum" control mechanism that operates similarly to the other control mechanisms simulating actual locomotive controls.

In American-made diesel railroad locomotives, the throttle includes a manually-operated lever which, depending on the particular model of locomotive, either projects generally horizontally from a vertically disposed control panel and is pivotally movable from side to side in a horizontal plane, or projects generally vertically from a horizontally disposed control panel and is pivotally movable from side to side in a vertical plane. However, in typical commercially-available model train controllers, the throttle is a rotatable protruding shaft, having a round gripping knob fitted thereto, for manually rotating the shaft to regulate the train speed.

Similarly, the direction and brake controls on full-scale locomotives are operated by manually-moved levers, whereas the corresponding model train controls typically are operated by simple back and forth sliding switch-type actuators or the like.

SUMMARY OF THE INVENTION

An important object of the invention is to provide a locomotive control simulator attachment or assembly for a model train controller which provides more realistic simulation of the controls of a full-size railroad locomotive.

A more specific object is to provide such an attachment which is adapted to be attached to or mounted on a model train controller of the type wherein train speed is controlled by rotation of a protruding shaft.

Another specific object is to provide such an attachment which is adapted to be attached to a model train controller having sliding actuators for switches or the like regulating other conditions of operation, such as direction, braking, and/or momentum.

A further object is to provide such an attachment which is relatively simple in construction and use, and economical to manufacture.

A preferred locomotive control simulator attachment in accordance with the invention includes a support adapted to be attached to a model train controller having a protruding throttle control shaft rotatable for regulating the train speed. The attachment further includes means engageable with a protruding portion of the shaft for reciprocally rotating the shaft, a throttle control lever simulating a locomotive throttle, means for mounting the throttle control lever on the support for reciprocal pivotal movement of the lever, and means for connecting the throttle control lever to the engageable means for operating the engageable means to reciprocally rotate the throttle control shaft upon said reciprocal pivotal movement of the throttle control lever. The throttle control lever movement thereby simulates the movement of a full-scale railroad locomotive throttle, in regulating the speed of a model train controlled by the controller.

In a further preferred embodiment of the invention, the support houses the aforesaid protruding shaft portion, engageable means, mounting means, and connecting means.

In a preferred specific embodiment, the throttle control lever of the attachment is pivotable reciprocally from side to side in a horizontal plane, thereby simulating the movement of the throttle in certain diesel railroad locomotives.

In another preferred specific embodiment, the throttle control lever of the attachment is pivotable reciprocally from side to side in a vertical plane, thereby simulating the movement of the throttle in certain other diesel railroad locomotives.

BRIEF DESCRIPTION OF THE DRAWINGS

The drawings illustrate preferred embodiments of the locomotive control simulator attachment of the invention, without limitation thereto. In the drawings, like elements are identified by like reference characters in each of the views; and:

FIG. 1 is a perspective view of a preferred embodiment of the attachment of the invention, shown attached to a conventional model train controller;

FIG. 2 is a perspective view of the attachment as viewed on line 2—2 of FIG. 1 in the direction of the arrows;

FIG. 3 is a perspective view of the model train controller shown in FIG. 1, with the attachment illustrated thereon in phantom lines;

FIG. 4 is a generally schematic, exploded perspective view of the support of the attachment illustrated in FIGS. 1 and 2;

FIG. 5 is an enlarged perspective view of the operating mechanisms of the attachment illustrated in FIGS. 1 and 2;

FIG. 7 is a further enlarged top plan view of the mechanisms of FIGS. 5 and 6, with parts broken away.

FIG. 8 is a fragmentary end elevational view of the mechanisms, taken substantially on line 8—8 of FIG. 7;

FIG. 9 is a fragmentary sectional view of the mechanisms, taken substantially on line 9—9 of FIG. 7;

FIG. 11 is an enlarged, exploded perspective view of the operating mechanisms of the attachment of FIG. 10, shown with a fragmentary portion of the controller of FIGS. 1 and 3.

DESCRIPTION OF THE PREFERRED EMBODIMENTS

Figure 6:
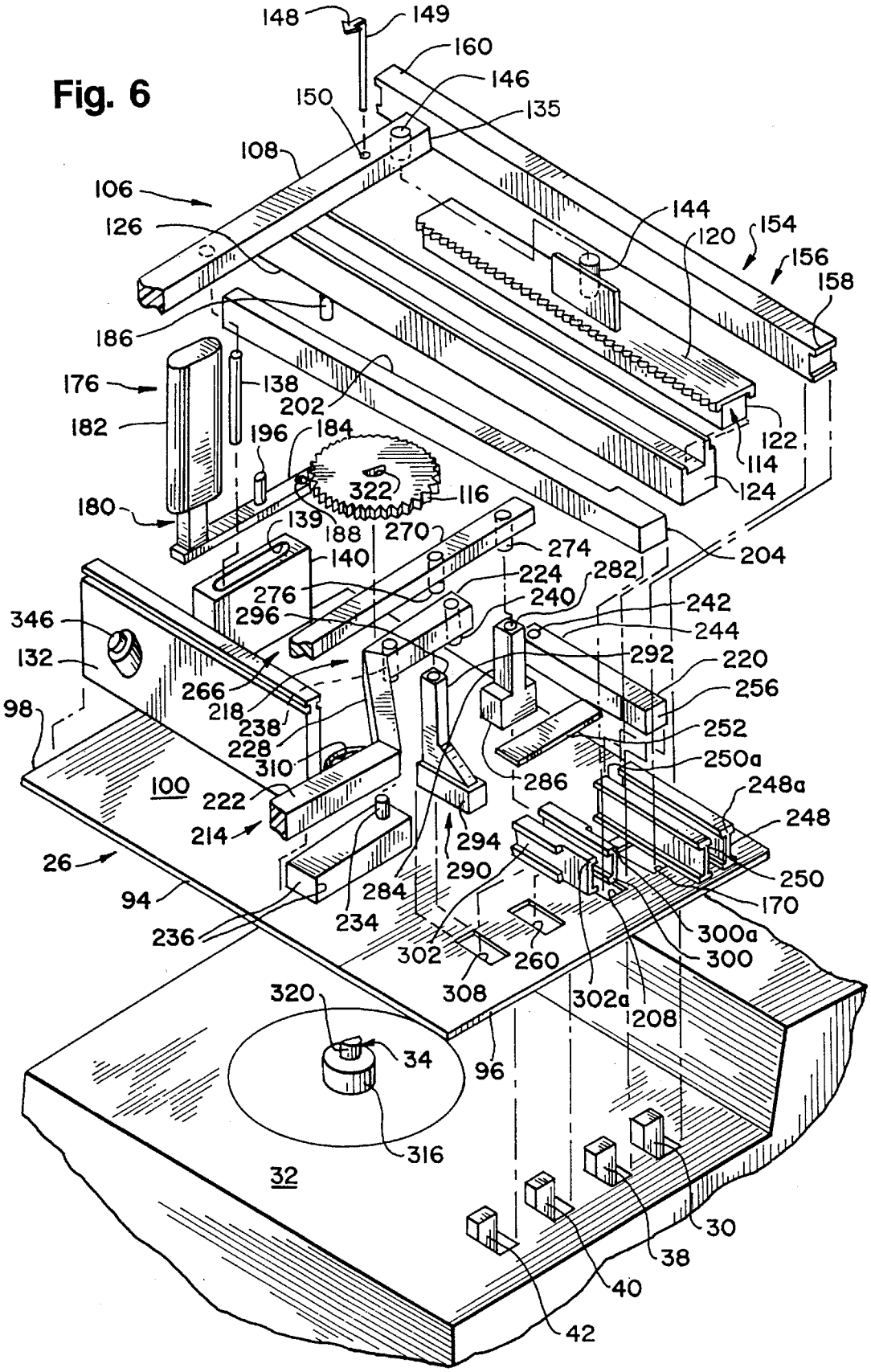
FIG. 6 is an enlarged, exploded perspective view of the mechanisms illustrated in FIG. 5, with parts broken away.

Referring to the drawings, particularly FIGS. 1–3, a locomotive control simulator attachment 20, constructed in accordance with a preferred embodiment of the invention, is shown attached to a conventional model train controller 22. The attachment 20 includes a box-like hollow support or mount 24 having a baseplate 26 fixedly secured within the support adjacent to the lower margin thereof. The baseplate 26 is seated on the controller 22. The attachment 20 is constructed to simulate a diesel locomotive throttle of the type that is pivotally moved from side to side in a horizontal plane.

THE CONTROLLER

The train controller 22 includes a hollow casing 28 which encloses regulating and/or control elements (not shown) for conditioning 115 volt alternating current (A.C.) for use in controlling an electric model train electrically connected to the controller. Typically, these elements may include a rectifier for conversion of alternating current to direct current, means for varying the voltage supplied to a controlled model train, thereby to control the train speed, and means for changing the polarity of the voltage, for changing direction of train movement.

The controller 22 is connected to a 115 volt A.C. supply by an electrical line cord (not shown). Conductors (not shown) electrically connect the controller 22 to the model railroad tracks and supply train control voltage thereto. An on-off slide power switch (not shown) housed within the casing 28 is actuated by a sliding power switch actuator 30 that protrudes from the casing 28 and extends above a rectangularly shaped upper surface 32 thereof. The power switch controls the supplying of electric power to the controller 22.

A cylindrical throttle control shaft 34 is reciprocally rotatable for adjusting a train-speed control element such as, for example, a variable transformer, or a potentiometer, thereby to control the speed of the train. The shaft 34 extends from within the casing 28 to above the upper surface 32 thereof. A gripping knob (not shown) customarily is fitted to a protruding portion of the shaft 34 for manually rotating the shaft to regulate the speed of a controlled train. The shaft 34 is rotated in a clockwise direction for increasing the speed, up to the maximum, and in a counterclockwise direction for reducing the speed, down to zero.

The illustrated controller 22 includes additional regulating or control elements, which cause the operation of the controlled model train to simulate the operation of a full-scale railroad train. These elements are actuated by slide switches controlling, respectively, "momentum, "direction", and "brake" action (none of the foregoing switches being shown), which switches are engaged and actuated by finger-movable, laterally reciprocatively slidable switch actuators 38, 40, and 42, respectively, that extend from within the casing 28 to above the upper surface 32 of the casing 28.

The "momentum" element causes the controlled model train to simulate the acceleration characteristics of an actual train, which when given a throttle increase suffers a lagtime or delay until the desired speed is reached. The "direction" element determines the forward or backward direction of travel of the model train. The "braking" element controls the slowing and stopping of the model train.

Three indicator lamps are carried in an upwardly and rearwardly sloping front surface 46 of the casing 28: a momentum-indicating lamp 48 is lit when the momentum on-off switch actuator 38 is in the "on" position; an overload lamp 50 is lit when excessive current is drawn by the controlled model train; a power monitor lamp 52 increases in brightness to indicate an increase in the amount of current supplied by the controller 22 as the throttle control shaft 34 is rotated clockwise. (A controller of the type illustrated is exemplified by the TECH 11® LOCO-MOTION 2500™ unit manufactured by the Model Rectifier Corp., Edison, N.J.)

FIRST EMBODIMENT OF THE ATTACHMENT

Support Structure

As best seen in FIGS. 1–4, the support 24 of the control simulator attachment 20 includes parallel opposing spaced apart, vertically disposed (in the preferred position of use) right and left side walls 60 and 62, respectively, an upwardly and forwardly sloping front apron wall 66, a downwardly and rearwardly sloping rear apron wall 68, and a cover 70. A small hollow auxiliary enclosure 64 extends laterally from the left side wall 62. Referring to FIG. 4, forward edges 60A and 62A of the respective side walls 60 and 62 slope inwardly and upwardly. Upper edges 60B and 62B of the respective side walls 60 and 62, extend substantially horizontally in the preferred position of use.

Referring to FIGS. 5–9, the baseplate 26 is substantially rectangular in shape, having a transverse front edge 94 and, perpendicular thereto, opposed right and left side edges 96 and 98, respectively. The baseplate 26 is substantially planar and rigid, and has an upper surface 100 and lower surface 102. The front edge 94 and right and left edges 96 and 98 of the baseplate 26 have substantially the same dimensions as the corresponding edges of the upper surface 32 of the controller 22.

Referring to FIG. 4, the side walls 60 and 62, the front apron wall 66, and the rear apron wall 68, are fixedly secured to one another, and to the base plate 26, to form a bottom section 76 of the support 24, having a cover opening 77 at the top of the section. The cover 70 includes an upwardly and rearwardly sloping front wall 78 and an integral top wall 80. The cover 70 is coextensive with, and covers and closes the cover opening 77, to form the support 24 with the bottom section 76, as illustrated in FIGS. 1–3.

The cover 70 is provided with suitable means for removably attaching it to the side walls 60 and 62 and the apron walls 66 and 68 of the bottom section 76. Simple and convenient attachment means may constitute strips of double-sided adhesive tape (not shown) secured to the upper edges of the apron walls 66 and 68, and to the upper edges of the side walls 60 and 62. Other means for removable attachment include hook-and-eye type (e.g. Velcro®) materials adhesively attached to the appropriate margins of the cover 70 and to the edges of the bottom section 76. When the cover 70 is attached to the bottom section 76, the top wall 80 of the cover 70 extends horizontally.

Referring to FIGS. 1–3, the auxiliary enclosure 64 includes a forward wall 84, a side wall 86, and a top wall 88. A short rear apron wall 90 slopes downwardly and rearwardly from the rear edge of the top wall 88. The inner edges of the respective forward and top walls 84 and 88 are rigidly secured to, or are constructed integral with, the left side wall 62 of the support 24. The upper surfaces of the top wall 88 and the rear apron wall 90 are coplanar with, respectively, the upper surfaces of the top wall 80 of the cover 70 and the rear apron wall 68 of the support 24.

The materials of construction of the support 24 and the auxiliary enclosure 64 preferably are light, rigid sheets of plastic and/or metal. In the case of plastic materials, the several walls and aprons may be secured together by any suitable means, such as, for example, by permanent adhesive, solvent welding, or ultrasonic welding. In the case of metal materials, the parts may be secured together by permanent adhesive, soldering, or brazing, for example. It will be apparent that conventional braces, gussets, struts, and the like (not shown) may be employed to aid in securing together the several walls and base of the support 24.

Power Control Mechanism

Referring to FIGS. 5–7, a power control mechanism, shown generally as 154, includes a transverse switch control bar 156, having a rectangular cross section, that is carried on the upper surface 100 of the base plate 26 for transverse slidable reciprocative movement thereon. Opposite right and left end portions 158 and 160 of the control bar 156 overhang, respectively, the right edge 96 and left edge 98 of the baseplate 26. The end portions 158 and 160 project for movement through openings 162 and 164 (FIG. 4) in the right side wall 60 and left side wall 62, respectively, of the support 24. The control bar 156 fits closely within the wall openings 162 and 164, to minimize side play.

A recess 168 (see FIGS. 7 and 8), complementary in shape to the on-off power switch actuator 30, is formed in the undersurface of the control bar 156 adjacent to the right end portion 158 thereof. The recess 168 is positioned above, and in substantial register with a rectangular slot 170 (FIG. 6) in the baseplate 26, to receive the actuator 30 in the recess. The power switch of the controller 22 is turned on or off by manually moving the right end portion 158 of the control bar 156 left or right, as the case may be, while the left end portion 160 is moved/moves correspondingly left or right.

The baseplate 26 carries several additional control mechanisms adapted operatively to engage with the remaining hereinabove-described actuators 38, 40 and 42 of the controller 22 when the attachment 20 is attached to the controller 22. Each such mechanism is provided with a manually movable control lever and is so constructed that movement of the lever causes movement of the engaged actuator thereby to control an operation of the model train, as described hereinafter.

Momentum Control Mechanism

Referring to FIGS. 5–7 and 9, a "momentum" control mechanism, generally indicated as 176, includes an L-shaped "momentum" control lever or operating arm 180 having an upright handle portion 182 and a horizontally-disposed leg 184. A first leg pivot pin 186 (see FIGS. 7 and 9) is fixedly mounted to a guide bar 124, adjacent to its left end portion 126, extends downwardly therefrom, and is captured for pivotal movement in a socket 188 formed in the distal end portion 189 of the leg 184. The auxiliary enclosure 64 (FIGS. 1 and 2) conceals the left end portion 126 of the guide bar 124 and the distal end portion 189 (FIGS. 7 and 9) of the leg 184. The handle portion 182 is disposed forwardly of the forward wall 84 of the auxiliary enclosure 64, thereby to make the handle portion 182 accessible for being manually moved.

A second leg pivot pin 196 (FIGS. 6, 7 and 9), spaced forwardly from the first leg pivot pin 186, is fixedly mounted on the leg 184, extends upwardly therefrom, and is received, loosely, for pivotal movement in a blind bore 198 (FIG. 9) formed in the underside of a transversely extending switch-operating rod 202.

The switch-operating rod 202 is square in cross section and is carried for reciprocative transverse sliding movement on the upper surface 100 of the baseplate 26 and substantially parallel to the front edge 94 thereof. The right end portion 204 of the operating rod 202 has formed in its undersurface a recess 206 (FIGS. 7 and 8) complementary in shape to the "momentum" switch actuator 38. The recess 206 is disposed above, and in substantial register with, a rectangular opening 208 (FIG. 6) in the baseplate 26, to receive the actuator 38 in the recess.

Movement of the handle portion 182 of the "momentum" control lever 180 reciprocatively in a horizontal plane causes the leg 184 to pivot about a fulcrum provided by the first leg pivot pin 186. This pivotal movement is transferred to the switch-operating rod 202 by the second leg pivot pin 196 and causes substantially translational, sliding, transverse movement of the rod 202. The bore 198 in the rod 202 which receives the second leg pivot pin 196 is sized to provide play therefore sufficient to prevent the arcuate path necessarily followed by the pivot pin 196 from having any substantial effect upon the translational, transverse movement of the operating rod 202.

The control mechanisms described hereinafter are constructed so that their levers move in paths and in manners similar to the movement of corresponding control handles in a full-scale locomotive. While the above-described "momentum" control mechanism 176 finds no counterpart in such a locomotive, the lever 180 thereof operates similarly to the actual locomotive controls.

Direction Control Mechanism

As best illustrated in FIGS. 5–7, a "direction" control mechanism, generally indicated as 214, includes a "direction" control lever or operating arm 218 and a directional switch-operating rod 220.

The control lever 218 includes a front section 222 and, parallel to and offset therefrom, a rear section 224. The respective front and rear sections 222 and 224, are substantially parallel to and spaced at increasing elevations above the upper surface 100 of the baseplate 26. A central section 228 of the control lever 218 is inclined downwardly (see FIG. 8) from the rear section 224 to the front section 222, thereby to complete the lever 218. The front section 222 extends through a cutout 233 (FIG. 4) provided in the front apron wall 66 of the support 24, and terminates in an external handle portion 232.

A block 236 (FIGS. 6 and 7) is fixedly mounted on the upper surface 100 of the baseplate 26. A front pin 234 is fixedly mounted in the block 236, extends upwardly therefrom, and is captured for pivotal movement in a bore 238 formed in the rear section 224 of the lever 218. The front pin 234 supports, and spaces, the control lever 218 above the upper surface 100 of the baseplate 26.

A rear pin 240 (FIGS. 6 and 7) is spaced apart rearwardly from the front pin 234. The rear pin 240 is fixedly carried in the rear section 224 of the lever 218, extends downwardly therefrom, and is received for pivotal movement in a bore 242 (FIG. 6) formed in a left end section 244 of the directional switch-operating rod 220.

The directional switch-operating rod 220 has a rectangular cross section and is mounted for reciprocative transverse sliding movement between two longitudinally extending, spaced apart, substantially parallel guide rails, 248 and 250. The guide rails 248 and 250 are fixedly mounted on the upper surface 100 of the baseplate 26 and are disposed substantially parallel to the front edge 94 thereof.

Opposing inwardly disposed upper flanges **248*a* and 250*a* of the respective guide rails 248 and 250 limit vertical movement of the directional switch-operating rod 220. A limit bar 252 bridges the guide rails 248 and 250 and is fixedly mounted to their respective upper surfaces. The limit bar 252 extends across, and is spaced slightly above, the switch-operating rod 202 of the momentum control mechanism 176, thereby to limit the vertical movement of the momentum switch-operating rod 202**.

The right end section 256 of the directional switch-operating rod 220 has formed in its undersurface a recess 258 (FIGS. 7 and 8) complementary in shape to the "direction" switch actuator 40. The recess 258 is disposed above, and in substantial register with, a rectangular slot 260 (FIG. 6) in the baseplate 26, to receive the actuator 40 in the recess.

Reciprocative pivotal movement, in a horizontal plane, of the handle portion 232 of the "direction" control lever 218 causes the lever to pivot on the front pin 234 as a fulcrum. This pivotal movement is communicated to the switch-operating rod 220 by the rear pin 240 and causes substantially translational transverse movement of the directional switch-operating rod 220. The guide rails 248 and 250 are spaced to provide sufficient play to allow for the slightly arcuate path necessarily traced by the rear pin 240 of the lever 218 as the handle portion 232 thereof is moved.

Brake Control Mechanism

As best illustrated in FIGS. 5–7, a "brake" control mechanism, generally indicated as 266, includes a longitudinally extending "brake" control lever or operating bar 270 spaced above, and substantially parallel to, the upper surface 100 of the baseplate 26. The control lever 270 extends through a slot 273 (FIG. 4) provided in the front wall 78 of the cover 70 of the support 24, and terminates in an external handle portion 272.

Referring to FIG. 6, a rear pin 274 and a front pin 276 are fixedly mounted on the "brake" control lever 270 and extend downwardly therefrom. The rear pin 274 is spaced rearwardly from the handle portion 272 of the bar 270. The front pin 276 is located intermediate the rear pin 274 and the handle portion 272.

The rear pin 274 is received for pivotal movement in a bore 282 formed in an upstanding post 284 having an inverted "T" shape. The crossbar, or base section 286 of the post 284 spans, and is fixedly mounted atop the guide rails 248 and 250 of the "direction" control mechanism 214 (see FIGS. 5 and 8).

An L-shaped "brake" switch-operating member 290 (FIGS. 5 and 6) includes an upstanding leg 292 and a horizontally disposed leg 294. The upstanding leg 292 is provided with a bore 296 which receives the front control lever pin 276 for pivotal movement in the bore. The "brake" control lever 270 is supported, and spaced above the upper surface 100 of the baseplate 26, by the post 284 and by the upstanding leg 292 of the switch-operating member 290.

The horizontal switch-operating member leg 294 is rectangular in cross section and is mounted for reciprocative transverse sliding movement between spaced apart, substantially parallel guide rails 300 and 302. The guide rails 300 and 302 are fixedly mounted on the upper surface 100 of the baseplate 26 and are disposed substantially parallel to the front edge 94 thereof. Opposing inwardly extending upper flanges **300*a* and 302*a* of the respective guide rails 300 and 302 limit vertical movement of the horizontal leg 294**.

A recess 306 (FIG. 7 and 8), complementary in shape to the "brake" switch actuator 42, is formed in the undersurface of the horizontal leg 294, distal to the upstanding leg 292. The recess 306 is disposed above, and in substantial register with, a rectangular slot 308 (FIG. 6) in the baseplate 26, to receive the actuator 42 in the recess.

Reciprocal pivotal movement in a horizontal plane of the handle portion 272 of the "brake" control mechanism 266 causes the control lever 270 to pivot on the rear pin 274 as a fulcrum. This pivotal movement is communicated by the front pin 276 to the "brake" switch-operating member 290, thereby causing substantially translational transverse movement thereof. The guide rails 300 and 302 are spaced to provide sufficient play to allow for the slightly arcuate path traced by the front pin 276 when the handle portion 272 is moved.

Throttle Control Mechanism

Referring to FIGS. 5–9, a throttle control mechanism is generally indicated as 106. It includes a throttle control lever 108 having a handle portion 110 at its front end, a rack assembly 114, and a pinion gear 116.

The rack assembly 114 includes a transversely extending rack or gear plate 120 fixedly mounted atop a similarly extending foot portion 122. The foot portion 122 is of substantially square cross section and is carried for reciprocative transverse sliding movement on a transverse guide bar 124 having a complementary generally U-shaped cross section. The guide bar 124 is fixedly mounted on the upper surface 100 of the base plate 26 parallel to the front edge 94 thereof. A left end portion 126 (FIGS. 5 and 7) of the guide bar 124 projects through an opening 128 (FIG. 4) in the left side wall 62 of the support 24, into the auxiliary enclosure 64.

Referring to FIG. 5, the throttle control lever 108 is disposed substantially parallel to the upper surface 100 of the baseplate 26, is spaced thereabove, and movably rests upon, respectively, the upper marginal surface 130 of a bulkhead 132, and a spacer 134. The bulkhead 132 is fixedly mounted atop the upper surface 100 of the baseplate 26 adjacent to the front edge 94 thereof, and the spacer 134 is fixedly mounted atop the rack 120 and supports the rear portion 135 of the lever 108.

Upward movement of the rear portion 135 of the throttle control lever 108 is limited by a transverse beam 136 spaced above and parallel to the guide bar 124. Referring to FIG. 4, the beam 136 is secured to the inside surface of the rear apron wall 68 of the support 24. The throttle control lever 108 extends through a slot 137 in the front wall 78 of the cover 70, and the handle portion 110 extends beyond the front edge of the baseplate 26.

Referring to FIGS. 5–7, a downwardly extending guide pin 138 is fixedly carried by the throttle control lever 108 adjacent to the central portion 133 thereof. The guide pin 138 is received for free pivotal and longitudinal translational movement in an elongate longitudinally extending guide slot 139 formed in a guide block 140. The guide block 140 is fixedly mounted on the upper surface 100 of the baseplate 26 and is disposed substantially normal to the front edge 94 thereof.

An upwardly extending rack pin 144 (FIGS. 5 and 6) is fixedly mounted atop the central portion of the rack 120. The rack pin 144 is captured for pivotal movement in a bore 146 extending through the rear portion 135 of the throttle control lever 108.

A model train speed-indicating arrow 148 is mounted on an upstanding rod 149 that is press-fitted into a bore 150 formed in the rear portion 135 of the throttle control lever 108. The rod 149 extends through an arcuate slot 151 (FIGS. 1 and 4) formed in the top wall 80 of the cover 70. The indicating arrow 148 is carried above the wall 80 and gives a visual indication of the train speed corresponding to the position of the rear portion 135 of the throttle control lever 108.

Referring to FIGS. 3 and 6, a longitudinally extending flat formed at the upper end portion of the throttle control shaft 34 provides a pinion gear-keying portion 320 thereat of semicircular cross section. The pinion gear 116 is provided with a complementary semicircular hub bore 322. The keying portion 320 of the shaft 34 is received in the hub bore 322, thereby to key, or lock, the pinion gear 116 to the control shaft 34. If desired, other suitable means may be employed to key or lock a control shaft of other shape, e.g., cylindrical, to a similar pinion gear. A removable collar 316 is fitted over the throttle control shaft 34 for spacing the pinion gear 116 at a distance above the upper surface 100 of the baseplate 26 sufficient for interengaging the pinion gear 116 and the rack 120 of the rack assembly 114.

In order to properly correlate the position of the throttle control lever 108 with the speed of the controlled model train, the control shaft 34 is rotated to its maximum clockwise position (maximum train speed), and the handle portion 110 of the throttle control lever is moved to the most leftward position. In such relative positions, the pinion gear 116 is attached to the control shaft 34. The teeth of the pinion gear 116 are interengaged or intermeshed with the teeth of the rack 120 of the rack assembly 114, so that transverse translational movement of the rack assembly 114 causes rotational movement of the pinion gear 116 and thus of the control shaft 34 to which the pinion gear 116 is keyed (see FIGS. 5, 7 and 9).

Movement of the handle portion 110 of the throttle control lever 108 reciprocally in a horizontal plane causes the control lever 108 to pivot on a longitudinally movable fulcrum provided by the guide pin 138 at the central portion 133 of the control lever 108. The lever movement is communicated to the rack assembly 114 by means of the rack pin 144, fixedly carried by the rack 120, which moves transversely over the baseplate 26 and drives the pinion gear 116.

The gearing of the rack 120 and the pinion gear 116 are selected so that the throttle control shaft 34 moves through substantially its entire range of rotation when the handle portion 110 of the throttle control lever 108 is moved between its extreme leftward and rightward positions.

Mounting The Attachment On A Controller

Referring to FIGS. 1–5, in order to mount the attachment 20 on the controller 22, the rod 149 mounting the indicator arrow 148 on the attachment is removed from the bore 150 in the throttle control lever 108. The cover 70 of the support 24 is removed, slipping it off over the handle portion 110 of the throttle mechanism 106 and the handle portion 272 of the brake control mechanism 266. A knob (not shown) customarily fitted to the throttle control shaft 34 of the controller 22 is removed. The baseplate 26 of the attachment 20 then is positioned above the upper surface 32 of the controller 22.

The rectangular slots 170,208, 260, and 308 (FIG. 6) formed in the baseplate 26 are spaced and dimensioned to be in register with, and to receive therethrough, the respective switch actuators 30, 38, 40 and 42 when the baseplate 26 is set atop the upper surface 32 of the controller 22, with the front and side edges of the baseplate adjacent to the corresponding edges of the upper surface 32. A circular opening 310 in the baseplate 26 is in register with, and receives therethrough, the throttle control shaft 34 and the collar 316 therearound.

The power control mechanism 154, the "momentum" control mechanism 176, the "direction" control mechanism 214, and the "brake" control mechanism 266 are manipulated to bring their recesses 168, 206,258, and 306 in register with the respective switch actuators 30, 38, 40 and 42, thereby to receive the actuators in the recesses as the baseplate 26 is set on the upper surface 32 of the controller 22 (see FIG. 8).

The baseplate 26 is removably attached to the upper surface 32 of the controller 22 by means, e.g., of double-sided adhesive tape, or of hook-and-eye type (Velcro ®) attaching material (neither shown) placed at the margins of the upper surface 32 of the controller 22, and/or the lower surface 102 (FIG. 8) of the baseplate 26. A skirt portion 312 (FIG. 1) of the support 24 of the attachment 20 overhangs the inwardly and upwardly sloping front and side margins of the casing 28 and serves further to position the support 24 on the surface 32.

The foregoing provisions for removable attachment of the baseplate 26 to the controller 22 help avoid invalidation of warranties on the controller 22 which might be caused by attachment methods requiring modification of the casing 28 of the controller, and, also, permit easy transferal of the attachment 20 to other controllers.

The pinion gear 116 next is engaged with or attached to the throttle control shaft 34, and intermeshed or interengaged with the rack or gear plate 120, as described hereinabove, thereby to complete assembly of the throttle control mechanism 106.

The cover 70 of the support 24 of the attachment 20 is replaced, passing the handle portions 110 and 272 of the throttle control and brake control mechanisms 106 and 266 through slots 137 and 273, respectively. The cover 70 is secured to the bottom section 76 of the support 24 as described hereinabove. The rod 149 mounting the speed-indicating arrow 148 is extended through the arcuate slot 151 and press-fitted into the bore 150 in the rear portion 135 of the throttle control lever 108, thereby to give a visual indication of the position of the lever rear portion 135. The position of the lever rear portion 135 relates to the degree of rotation of the throttle control shaft 34 and, thus, to the speed of the controlled train. Indicia 342 are provided along the margin of the slot 151 for assigning (arbitrary) numerical values to the train speed.

A power on-off indicator lamp 346 (FIGS. 5 and 6) mounted in the bulkhead 132 is connected, by means of conductors 348 (FIG. 2) carried in a conduit 350, to low voltage terminals (not shown) at the rear of the train controller 22. The lamp 346 is lit when the controller is turned on by actuating its on-off power switch (not shown), by operation of the power switch mechanism 154, and is visible through an aperture 352 (FIGS. 1 and 4) in the front wall 78 of the cover 70.

It will be noted that the sloping rear apron wall 68 of the support 24 permits an unobstructed view of the momentum-indicating lamp 48, the overload lamp 50, and the power monitor lamp 52 of the controller 22.

With the attachment 20 attached to the controller 22, the controls of the controller 22 are operated by manipulation of the handle portions of the several control mechanisms of the attachment 20, as described hereinabove, to operate a model train.

SECOND EMBODIMENT OF THE ATTACHMENT

Figure 10:
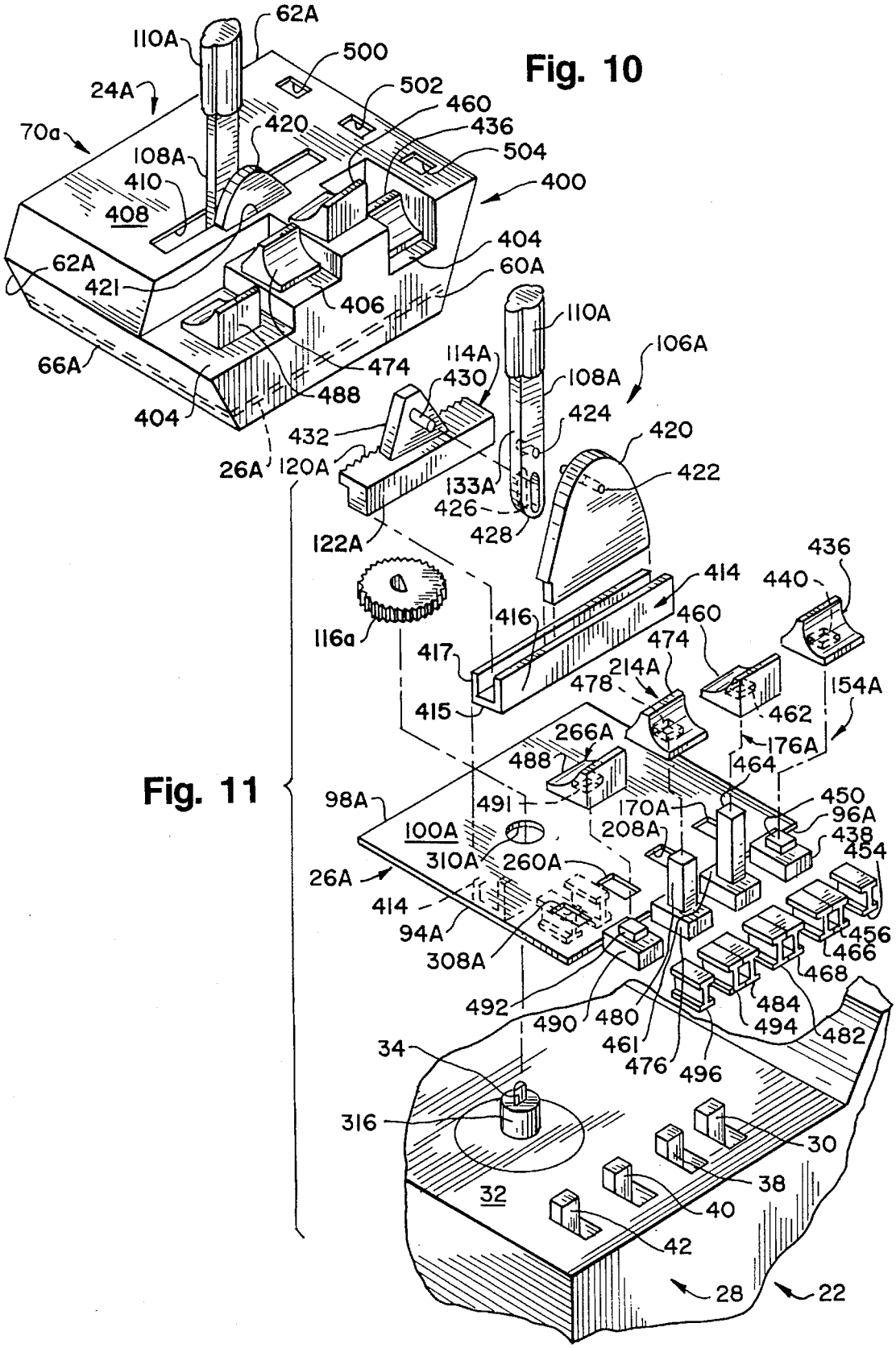
FIG. 10 is a perspective view of another embodiment of the attachment of the invention.

FIGS. 10 and 11 illustrate a locomotive control simulator attachment 400, which constitutes a second embodiment of the invention. The attachment 400 is constructed to simulate a diesel locomotive throttle of the type that is pivotally moved from side to side in a vertical plane.

The structure of the attachment 400 is similar to that of the attachment 20 constituting the first embodiment, but with certain changes necessitated by the different spatial movement of the throttle control handle of the second embodiment 400. Accordingly, in the interest of brevity, the parts of the second embodiment 400 are identified by the reference numerals applied to the same or similar parts of the first embodiment 20, with the addition of the letter "A" thereto, and additional structure is identified by additional reference numerals.

The second locomotive control simulator attachment 400 includes a generally box-shaped support 24A having a baseplate 26A. The baseplate 26A is fixedly secured within the support 24A, adjacent to the lower margin thereof. The support 24A has opposing, spaced apart, vertically disposed right and left side walls 60A and 62A, respectively, an upwardly and forwardly sloping apron wall 66A, and a cover 70A. The rear of the support 24A is open, i.e., no rear apron wall corresponding to the rear apron wall 68 of the support 24 of the first embodiment is provided. The cover 70A of the second embodiment is removably attached to the walls 60A, 62A, and 66A, in the manner described hereinabove for the cover 70 of the support 24 of the first embodiment.

The baseplate 26A has substantially the same shape and dimensions as the baseplate 26 of the first embodiment, and has a front edge 94A and opposed right and left side edges 96A and 98A, respectively. Control mechanisms are carried on the baseplate 26A for operative engagement with the controller actuators 30, 38, 40 and 42 described hereinabove.

The cover 70A includes three discrete, substantially horizontal sections of upper wall surface: a lowermost section 404, an intermediate section 406 spaced above the lowermost section 404, and an uppermost section 408 spaced above the intermediate section 406.

A throttle control mechanism, generally indicated as 106A, includes a throttle control lever 108A having a handle portion 110A at its outer end, a rack assembly 114A, and a pinion gear 116A.

The rack assembly 114A includes a longitudinally extending rack or gear plate 120A integral with a similarly extending foot portion 122A of substantially square cross section. The foot portion 122A is carried for slidable movement in an elongate guide trough 414 having a substantially square U-shaped cross section complementary to that of the foot portion.

The guide trough 414 includes a bottom wall 415 and, extending upwardly therefrom, spaced apart parallel right and left walls 416 and 417, respectively. The guide trough 414 is fixedly mounted on the upper surface 100A of the baseplate 26A and is disposed substantially normal to the front edge 94A thereof.

The throttle control lever 108A extends through a rectangular slot 410 in the cover 70A that is aligned perpendicularly to the baseplate front edge 94A. The lever 108A is disposed in a plane generally perpendicular to the upper surface 100A of the base plate 26A, and its handle portion 110 extends outwardly beyond the cover 70A.

The throttle control lever 108A is mounted for pivotal movement in a vertical plane on an upright rounded mounting panel 420. The mounting panel 420 is fixedly mounted on top of the right wall 416 of the guide trough 414, and extends through a slot 421 adjacent to the lever slot 410 in the cover 70A. A lever-mounting pin 422 is fixedly mounted to and extends from the panel 420. The mounting pin 422 is spaced above the upper surface 100A of the base plate 26A, is disposed substantially parallel to the front edge 94A of the base plate, and extends toward the left edge 98A of the base plate. The mounting pin 422 is received in a bore 424 extending through the central portion 133A of the throttle control lever 108A, for pivotal movement of the lever about the mounting pin.

An elongate bearing slot 426 extends through the throttle control lever 108A in the inner end portion 428 thereof. A rack drive pin 430 is mounted in and projects from a standard 432 secured to the top of the rack 120A. The drive pin 430 is received in the bearing slot 426 in the throttle lever 108A, in engagement with the lever for driving the rack by the lever.

A power control mechanism generally indicated as 154A includes a finger-graspable manually operated power handle 436 and a power switch-actuating bar 438 therebelow. The handle 436 has formed in its underside a rectangular recess 440 complementary in shape to that of a rectangular power handle mount 450 atop the switch-actuating bar 438. The handle 436 thus is adapted to be press-fit onto the mount 450.

The power switch-actuating bar 438 is carried between opposed, spaced apart, substantially parallel guide rails 454 and 456, for reciprocative sliding movement therebetween. The guide rails 454 and 456 are fixedly mounted on the upper surface 100A of the baseplate 26A, are disposed parallel to the front edge 94A thereof, and straddle a rectangular slot 170A in the baseplate. An actuator-receiving recess (not shown) formed in the undersurface of the switch-actuating bar 438 is complementary in shape to that of the power switch-actuator 30 of the controller 22, for receiving the actuator 30 in the recess.

A "momentum" control mechanism generally indicated as 176A includes a finger-graspable manually operated "momentum" handle 460 and a "momentum" switch-actuating bar 461. A rectangular recess 462 formed in the undersurface of the "momentum" handle 460 is complementary in shape to a rectangular "momentum" handle mount 464. The mount 464 projects upwardly from the "momentum" switch-actuating bar 461 and received in press-fitting engagement in the recess 462.

The "momentum" switch-actuating bar 461 is carried between opposed, spaced apart, substantially parallel guide rails 466 and 468 for reciprocative sliding movement therebetween. The rails 466 and 468 are fixedly mounted on the upper surface 100A of the baseplate 26A and are disposed substantially parallel to the front edge 94A thereof. The guide rails 466 and 468 straddle a rectangular slot 208A in the baseplate 26A. An actuator-receiving recess (not shown) formed in the undersurface of the "momentum" switch-actuating bar 461 is complementary in shape to that of the "momentum" switch actuator 38 of the controller 22, for receiving the actuator 38 in the recess.

A "direction" control mechanism generally indicated as 214A includes a finger-graspable "direction" handle 474 and a "direction" switch-actuating bar 476. A recess 478 is formed in the undersurface of the "direction" handle 474 complementary in shape to that of a rectangular "direction" handle mount 480 extending upwardly from the actuating bar 476. The recess 478 receives the mount 480 in a press fit therein.

The "direction" switch-actuating bar 476 is carried between opposed, spaced apart, substantially parallel guide rails 482 and 484 for reciprocative sliding movement therebetween. The rails 482 and 484 are disposed parallel to the front edge 94A of the baseplate 26A, are fixedly mounted to the upper surface 100A thereof, and straddle a rectangular slot 260A therein. An actuator-receiving recess (not shown)

formed in the undersurface of the "direction" switch-actuating bar 476 is complementary in shape to the "direction" switch actuator 40 of the controller 22, for receiving the actuator 40 in the recess.

A "brake" control mechanism, generally indicated as 266A, includes a finger-graspable "brake" handle 488, and a "brake" switch-actuating bar 490. A recess 491 formed in the undersurface of the "brake" handle 488 is complementary in shape to a rectangular "brake" handle mount 492 extending upwardly from the actuating bar 490 and receives the mount 492 in a press fit therein.

The "brake" switch-actuating bar 490 is carried between opposed, substantially parallel guide rails 494 and 496 for reciprocative sliding movement therebetween. The guide rails 494 and 496 are fixedly mounted to the upper surface 100A of the base plate 26A, are disposed parallel to the front edge 94A thereof, and straddle a rectangular slot 308A therein. An actuator-receiving recess (not shown), formed in the undersurface of the actuating bar 490 is complementary in shape to the "brake" switch actuator 42 of the controller 22, for receiving the actuator 42 in the recess.

The attachment 400 is attached to the controller 22 in a manner similar to the first-described attachment 20, with certain changes necessitated by differences in structure. Initially, the knob (not shown) customarily fitted to the throttle control shaft 34 is removed, and the collar 316 is placed around the shaft 34. The baseplate 26A is then positioned above the upper surface 32 of the casing 28 of the controller 22, with the baseplate slots 170A, 208A, 260A and 308A in register with the switch actuators 30, 38, 40, and 42, respectively.

The baseplate 26A is set atop the upper surface 32 of the controller 22 with the several switch actuators 30, 38, 40 and 42 extending through the respective base plate slots and received in the recesses (not shown) in the bases of the actuating bars 438, 461, 476, and 490, respectively. The throttle control actuator shaft 34 and the collar 316 extend through a circular opening 310A in the baseplate 26A. The baseplate 26A is then removably fastened to the casing surface 32 in the manner described hereinabove for the baseplate 26 of the first attachment 20.

The pinion gear 116A is engaged with or attached to the throttle control shaft 34 and interengaged with the rack 120A in similar manner to that described hereinabove for the pinion gear 116 and the rack 120 of the first attachment 20. To obtain the proper correlation between the speed of the controlled train and the position of the throttle control lever 108A, the actuator shaft 34 is rotated to its full clockwise position, and the handle 110A of the lever 108A is moved to its rearmost position, after which the gear 116A is mounted in place.

The cover 70A is mounted on the support walls 60A, 62A and 66A, with the lever 108A extending through the cover slot 410, and the mounting panel 420 extending through the cover slot 421. The upper end portions of the power handle mount 450 and the "brake" handle mount 492 extend through respective rectangular slots (not shown) in the lowermost upper wall surface section 404 of the cover 70A. The upper end portions of the "momentum" handle mount 464 and the "direction" handle mount 480 extend through respective rectangular slots (not shown) in the uppermost and intermediate upper wall surface sections 408 and 406, respectively, of the cover 70A. The several finger-graspable handles 436,460, 474 and 488 are press-fitted onto the upper end portions, extending through the cover 70A, of their respective handle mounts.

Movement of the throttle control lever handle 110A back and forth in a vertical plane causes the lever 108A to pivot on a fulcrum provided by the lever-mounting pin 422. The movement of the lever handle 110A causes the rack 120A to move linearly in opposite directions to the lever handle 110A. The rack movement rotates the pinion gear 116A and thus the throttle control shaft 34, to increase or decrease the model train speed. Reciprocative transverse movement of each of the power handle 436, the "momentum" handle 460, the "direction" handle 474, and the to the handle.

The uppermost upper wall surface section 408 on the cover 70A is provided with three transversely spaced apart rectangular openings 500, 502, and 504, adjacent to the rear margin of the cover. These openings afford views of the momentum indicating lamp 48, the overload lamp 50, and the power monitor lamp 52, respectively, of the controller 22, illustrated in FIGS. 1 and 3.

The various components of the hereinabove-described control mechanisms preferably are made of rigid plastic, or may be formed of metal. Those components described as "fixedly mounted" to the baseplates 26 and 26A may be made so by virtue of being integrally so molded (plastic) or cast (metal). Alternatively, discrete components may be fixedly mounted by means such as ultrasonic welding, or solvent welding (plastic materials), for example; by soldering, welding or brazing (metal); or by permanent adhesive (metal or plastic).

While preferred embodiments of the invention have been described and illustrated, it will be apparent to those skilled in the art that various changes and modifications may be made therein within the spirit and scope of the invention. It is intended that all such changes and modifications be included within the scope of the claims.

I claim:

1. A locomotive control simulator attachment for a model electric train controller, said controller including a throttle control shaft having a portion protruding from the controller and being reciprocally rotatable for regulating the train speed, said attachment comprising, in combination:

a support adapted to be attached to said controller in register with said protruding shaft portion;

means engageable with said protruding shaft portion for reciprocally rotating the shaft when said support is attached to said controller;

a throttle control level simulating a locomotive throttle;

means for mounting said throttle control lever on said support permitting reciprocal pivotal movement of the lever; and means for connecting said throttle control lever to said engageable means for operating the engageable means to reciprocally rotate said throttle control shaft upon said reciprocally pivotal movement of said throttle control lever, thereby allowing a user to regulate power applied to a model train controlled by said controller having said attachment attached thereto, with said throttle control lever reciprocal movement simulating the movement of a full-scale railroad locomotive throttle.

2. An attachment as defined in claim 1 and wherein said support is adapted upon attachment to said a controller to contain therein each of said protruding shaft portion, said engageable means, said mounting means, and said connecting means.

3. An attachment as defined in claim 1 and wherein said controller includes at least one reciprocatively sliding actuator having a portion protruding from the controller and being adapted for regulating another condition of operation of a controller model train, and wherein said attachment includes engageable with said protruding portion of said at least one actuator for sliding the actuator reciprocatively when said support is attached to said controller, at least one additional control lever, means for mounting said at least one additional control lever on said support permitting reciprocal pivotal movement of the additional control lever, and means for connecting said at least one additional control lever to said means engageable with said protruding at least one actuator portion for operating the latter engageable means to slide said at least one actuator reciprocatively upon reciprocal pivotal movement of said at least one additional control lever.

4. An attachment is defined in claim 3 wherein said at least one actuator comprises a momentum switch actuator, a direction switch actuator, or a brake switch actuator.

5. An attachment as defined in claim 3 and, wherein said support is adapted upon attachment to a said controller to contain therein each of said protruding shaft portion, said means engageable with said protruding shaft portion, said means for mounting said throttle control lever on said support, said means for connecting said throttle control lever to said means engageable with said protruding shaft portion, said protruding portion of said at least one sliding actuator, said means engageable with said protruding actuator portion, said means for mounting said at least one additional control lever on said support, and said means for connecting said at least one additional control lever to said means engageable with said protruding actuator portion.

6. A locomotive control simulator attachment for a model electric train controller, said controller including a throttler control shaft having a portion protruding from the controller and being reciprocally rotatable for regulating the train speed, said attachment comprising, in combination:

a support adapted to be attached to said controller; in register with said protruding shaft portion;

a pinion gear adapted for being keyed to said protruding shaft portion for reciprocally rotating the shaft thereby when said support is attached to said controller;

a rack drivingly engageable with said gear;

a throttle control lever simulating a locomotive throttle;

means for drivingly connecting said throttle control lever to said rack with said rack engaging said gear; and means for mounting said throttle control lever on said support permitting reciprocal pivotal movement of the lever while connected to said rack, thereby to reciprocate said rack in engagement with said gear for reciprocally rotating said throttle control shaft, to regulate power applied to a model train controlled by said controller having said attachment attached thereto, with said throttle control lever reciprocal movement simulating the movement of a full-scale railroad locomotive throttle.

7. An attachment as defined in claim 6 and wherein said support is adapted upon attachment to a said controller to contain therein each of said protruding shaft portion, said gear, said rack, said means for connecting said throttle control lever to said rack, and said means for mounting said throttle control lever.

8. An attachment as defined in claim 6 and wherein said controller includes at least one reciprocatively sliding actuator having a portion protruding from the controller and being adapted for regulating another condition of operation of a controlled model train, and wherein said attachment includes means engageable with said protruding portion of said at least one actuator for sliding the actuator reciprocatively when said support is attached to said controller, at least one additional control lever, means for mounting said at least one additional control lever on said support permitting reciprocal pivotal movement of the additional control lever, and means for connecting said at least one additional control lever to said means engageable with said protruding at least one actuator portion for operating the latter engageable means to slide said at least one actuator reciprocatively upon reciprocal pivotal movement of said at least one additional control lever.

9. An attachment is defined in claim 8 and wherein said at least one actuator comprises a momentum switch actuator, a direction switch actuator, or a brake switch actuator.

10. An attachment as defined in claim 8 and wherein said support is adapted upon attachment to a said controller to contain therein each of said protruding shaft portion, said gear, said rack, said means for connecting said throttle control lever to said rack, said means for mounting said throttle control lever on said support, said protruding portion of said at least one sliding actuator portion, said means engageable with said protruding actuator portion, said means for mounting said at least one additional control lever on said support, and said means for connecting said at least one additional control lever to said means engageable with said protruding actuator portion.

* * * * *